US007458140B2

(12) United States Patent
Harris

(10) Patent No.: US 7,458,140 B2
(45) Date of Patent: Dec. 2, 2008

(54) METHOD FOR CONVERTING A CHAIN LINK FENCE

(76) Inventor: Martin P. Harris, 3632 30th Ave. South, Minneapolis, MN (US) 65406

( * ) Notice: Subject to any disclaimer, the term of this patent is extended or adjusted under 35 U.S.C. 154(b) by 0 days.

(21) Appl. No.: 10/999,273

(22) Filed: Nov. 29, 2004

(65) Prior Publication Data

US 2006/0113518 A1 Jun. 1, 2006

(51) Int. Cl.
*B21K 21/16* (2006.01)
*E04H 17/16* (2006.01)

(52) U.S. Cl. ..... 29/401.1; 256/24

(58) Field of Classification Search ..... 29/401.1, 29/7.1, 897, 897.1; 256/24; 52/157
See application file for complete search history.

(56) References Cited

U.S. PATENT DOCUMENTS 4,803,812 A * 2/1989 Alexander, Sr. ..... 52/157

* cited by examiner

*Primary Examiner*—John C Hong

(57) ABSTRACT

The present invention relates to a method and apparatus for use in the conversion of a chain link fence into any new type of fence. The present invention includes removing all of the existing parts of a chain link fence except for the original supporting fence posts, coring or drilling out new fence posts, inserting the new fence posts over the original supporting fence posts, and securing the new fence posts to the original supporting posts.

16 Claims, 3 Drawing Sheets

METHOD FOR CONVERTING A CHAIN LINK FENCE

BACKGROUND OF THE INVENTION

1. Technical Field

The present invention relates to a method and apparatus for converting a chain link fence into a new type of fence, including but not limited to: a picket fence, a stockade fence, vinyl fence, or any other alternative to the original chain link fence.

2. Description of Related Art

A chain link fence is a popular and inexpensive option among the various types of fencing that exists in the marketplace. Chain link fences provide sturdy barriers for users who want to either keep things in or out. Chain link fences may also be adapted with barbed or razor wire at the top to keep people from crossing their intended boundaries. However, the chain link fence has many drawbacks, including the lack of privacy resulting from the open links in the fence, the lackluster metal appearance and the failure to add to the value of the property in comparison to other types of fencing.

One attempt to resolve some of the drawbacks of chain link fencing was examined in U.S. Pat. No. 6,126,146 to Melton. The Melton patent discloses a plurality of fence planks which are held in shaped retaining plugs. The retaining plugs hold the planks to the chain link fence and alter the appearance of the fence. The drawback to this invention is that the entire, original chain link fence remains, and is visible upon close inspection. While the Melton patent describes an "apparatus to convert a chain link fence such that it will appear like a wooden plank fence," there is no removal of any of the parts of the original chain link fence and thus can be differentiated from the present invention. The Melton patent teaches the installation of planks by way of rear tapered mounting blocks to engage the planks. Such a system acts to cover the whole of the existing chain link fence.

What is needed is a method and apparatus for the improved conversion of a chain link fence into any new type of fence with ease, little cost and without sacrificing strength in the new fence or satisfaction of appearance.

SUMMARY OF THE INVENTION

The present invention relates to a method and apparatus for converting a chain link fence to another type of fence while maintaining only the support posts of the original chain link fence. New posts are installed over and encompass the original support posts of the chain link fence and utilize the original support within the ground. Then, the remainder of the new fence is attached to the new posts.

The present invention differs from the prior art and specifically the Melton patent by removing all parts of the existing chain link fence, such as the webbing, top and bottom rails, gates, tension bands, post bands and post caps, except for the original support posts. This procedure leaves only the support posts that were originally installed or cemented into the ground. New posts are then cored to fit over the original support posts. After the new posts are positioned over and secured to the original support posts, the remainder of the new fence is installed. Any type of securing means or device that is known in the art may be utilized to secure the new posts to the original support posts such as bolts, screws, foam, injection molding, or adhesive. In one embodiment, the securing means is not necessary. Furthermore, a type of filler, composite, foam or other like material may be used to fill any gaps between the original support posts and the new posts. Once the new posts are secured, the remainder of the new fence may be installed.

The new type of fence includes any alternative to the original chain link fence where the new posts are of a greater cross sectional area than the cross sectional area of the original support posts so that the new posts may be positioned over and encompass the original support posts. Such new types of fences may include, but are not limited to a picket fence, stockade fence, vinyl fence, or any other alternative to the original chain link fence. A stockade fence includes any type of solid fence known in the art.

The true embodiments of the present invention may be best appreciated as detailed in the description and drawings contained herein.

An object of the present invention is to provide a method and apparatus for the improved conversion of a chain link fence into any new type of fence with ease, little cost and without sacrificing strength in the new fence or satisfaction of appearance.

Another object if the present invention is to provide a method and accompanying apparatus for the simple and cost-effective conversion of a chain link fence into any other type of fence with a do-it-yourself kit or professional custom system.

All objects and embodiments of the present invention will be appreciated from the description and drawings contained herein.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
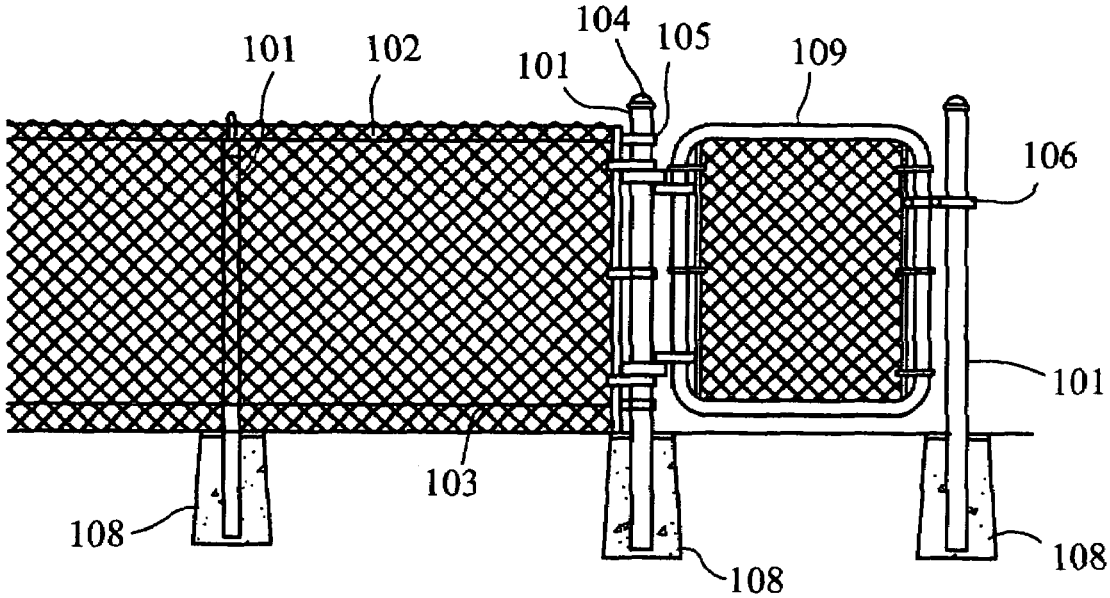
FIG. 1 Prior Art
FIG. 1 is an example of a prior art of a chain link fence as it traditionally exists in its completed state.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

FIG. 1 represents a typical chain link fence. In the present invention, all parts of the chain link fence are removed except original support post 101 and support material 108. Typically, what is removed includes, but is not limited to top rail 102, bottom tension band 103, post tops 104, rail bands 105, gate bands 106, and gate 109.

Figure 2:
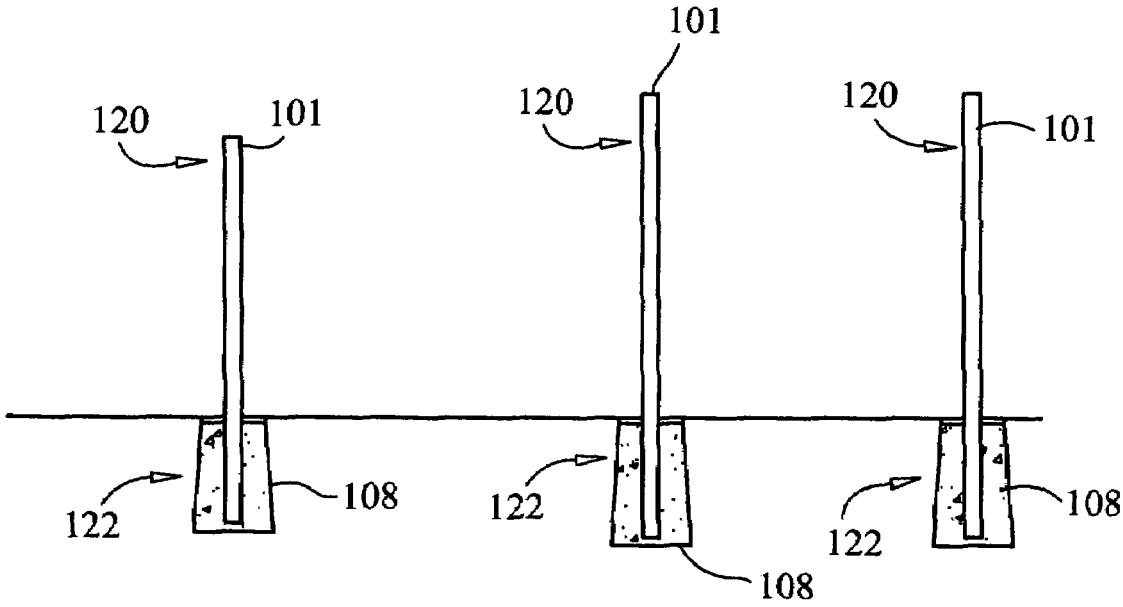
FIG. 2 Prior Art
FIG. 2 is an example of a prior art chain link fence after all of the parts are removed except for the original support posts that are secured or anchored in the ground.
Figure 6:
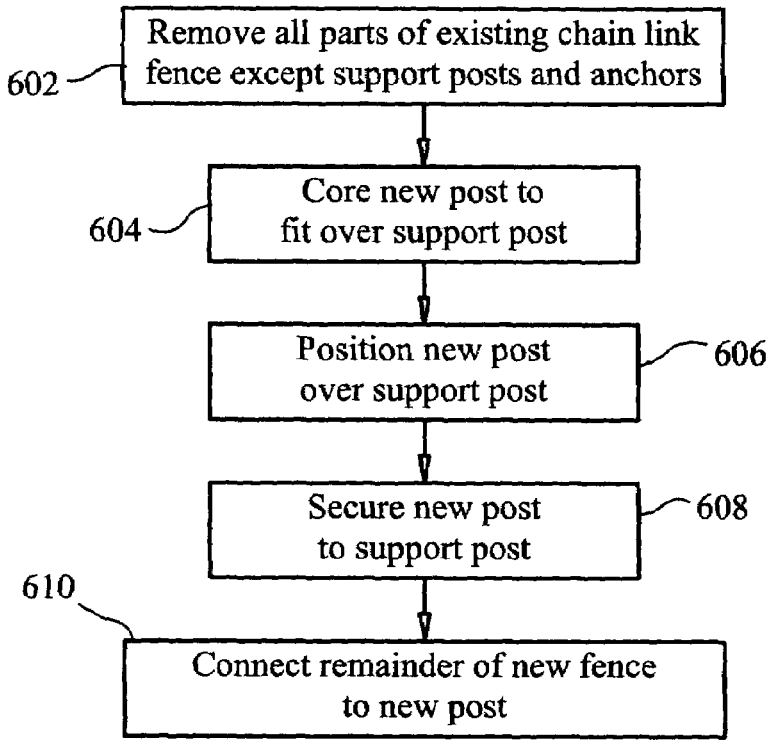
FIG. 6 is a flow chart depicting the steps involved in converting a chain link fence into a new type of fence as an embodiment of the method of the present invention.

FIG. 2 represents what remains when all the parts of the existing chain link fence except original support post 101 and support material 108 are removed. (See FIG. 6, Step 602) Original chain link supporting post 101 remain in the ground and serve as support for the new posts with top end 120 sticking vertically out of the ground.

Original support post 101 for the original chain link fence contains top end 120 and bottom end 122. Bottom end 122 is secured within the ground by support material 108. Support material 108 may be cement or any other material known in the art and used for providing support for or to anchor the original support post 101 into the ground.

Figure 3:
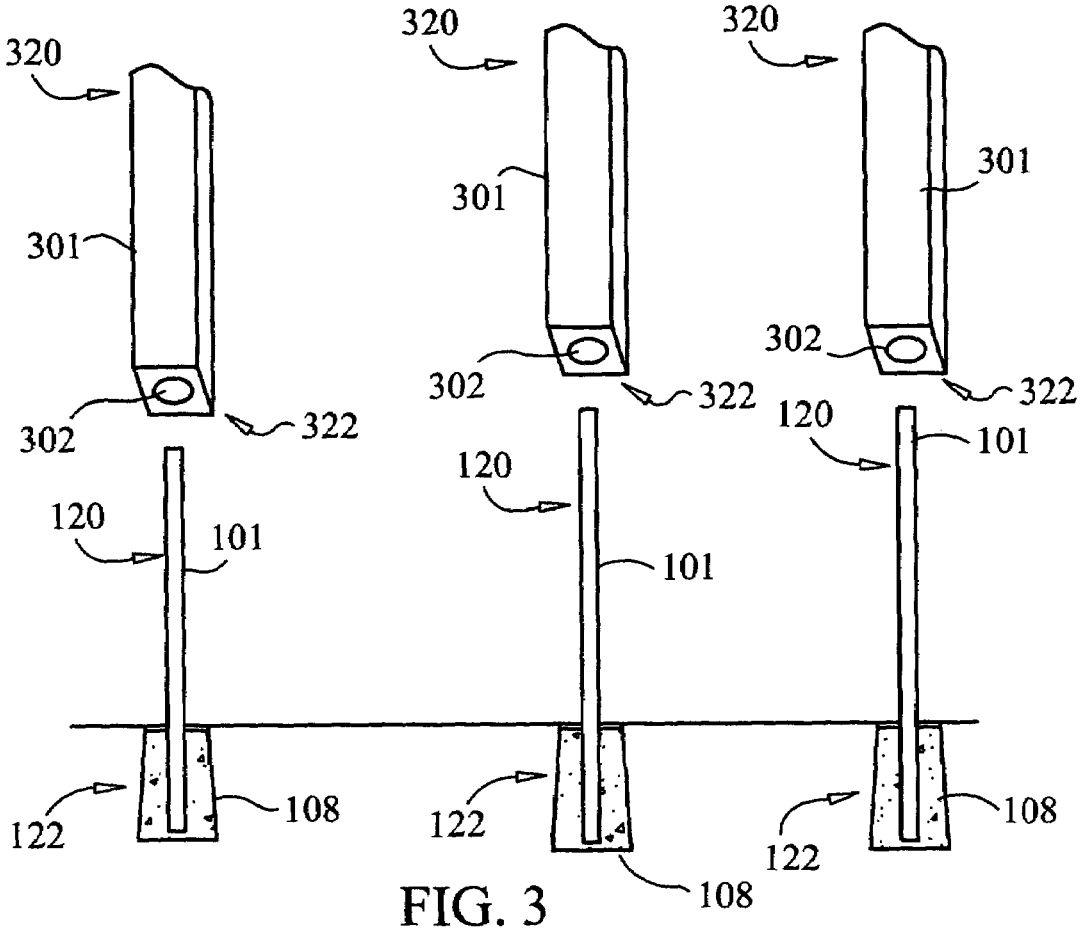
FIG. 3 is an example of a new post of the present invention.

FIG. 3 represents a cored new post 301 having upper end 320 and bottom end 322. Bottom end 322 contains cavity 302. Cavity 302 enables the positioning of new post 301 over original support post 101. The depth of the cavity 302 runs along the y axis of the vertical length of the new post 301. Cavity 302 partially extends up and generally runs parallel to the length of new post 301 and is at least the length needed to accommodate a portion of original support post 101.

The cross sectional area of cavity 302 is at least approximately 1/100 of an inch greater in size, and preferably approximately 1/64 inch greater in size than the cross sectional area of original support post 101. For example, as shown in FIG. 3, if original support post 101 is circular, then cavity 302 may have a circular circumference at least approximately 1/100 of an inch or greater in diameter, and preferably approximately 1/64 of an inch or greater in diameter than the circular circumference of original support post 101. In another embodiment, cavity 302 may be a square, triangle, or any other shape but the cross sectional area of the shape is at least approximately 1/000th of an inch greater than the cross sectional area of original support post 101. Original support post 101 may have any cross sectional shape such as square, triangle or any other shape. The cross sectional shape of new post 301 and cavity 302 does not have to be the same cross sectional shape as original support post 101.

New posts 301 may be prefabricated or cored on site depending upon the preferences of the consumer. The circumference and depth of cavity 302 depends upon several factors, including but not limited to the cross-sectional circumference, size, and height of original support post 101, and the amount of gap, if any, desired between original support post 101 and new post 301.

A gap may be desired to allow for expansion and contraction of original support post 101 and/or new post 301 due to elemental conditions, to account for any minor deformity in original support post 101 or for ease of insertion of new post 301 over original support post 101.

After new post 301 is cored to create a cavity 302, new post 301 is inserted over and encompasses original support post 101, whereby original support post 101 fits inside cavity 302. (See FIG. 6, Step 606) Insertion of original support post 101 into cavity 302 may be facilitated through the use of a temporary or permanent lubricant to allow for easy insertion. Also, original support post 101 may be cut to reduce the height so as to more easily fit into cavity 302.

After new post 301 is inserted over and encompasses original support post 101, any gap between original support post 101 and new post 301 may be filled with foam, injection molding, adhesive or similar material to help secure new post 301 to original support post 101. If new post 301 is of a material that readily expands or contracts with the elements, then the gap may be filled with a material that would compensate for the expansion and contraction, such as a foam or other similar material known in the art.

Figure 4:
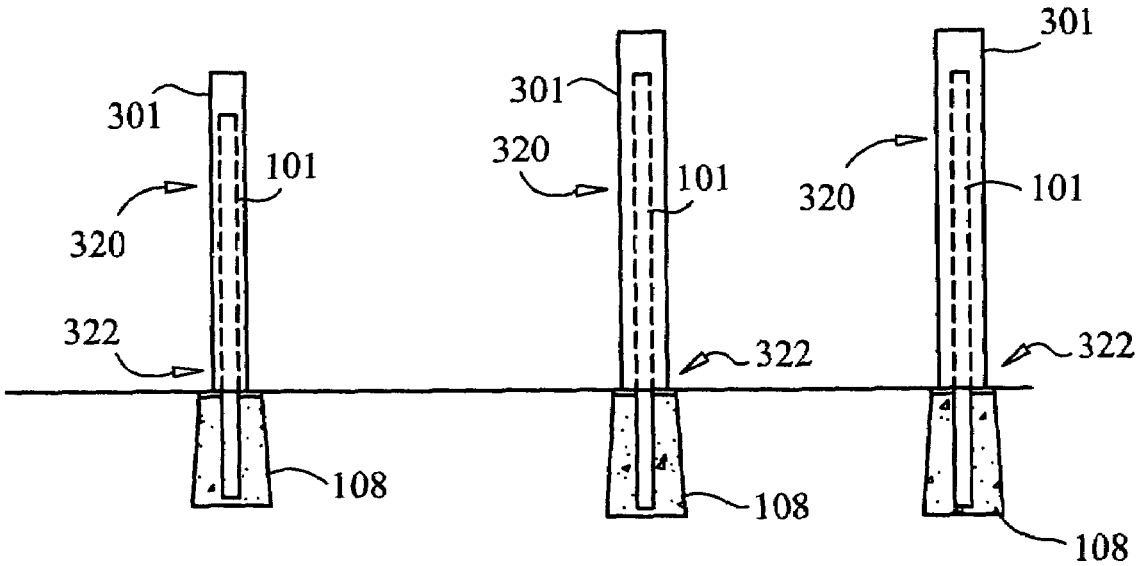
FIG. 4 is a representation of a new post fitted over an original chain link fence post in accordance with the present invention.

FIG. 4 represents new posts 301 as it would exist when fitted over original support post 101. The dotted lines represent original support post 101 inside cavity 302. Cavity 302 is preferably cored to a length that is approximately equivalent to the length of original support post 101. After new post 301 is fitted over original support post 101, new post 301 may be secured to original support post 101 by filling any gaps with a foam, composite, injection molding or other material, or securing with at least one fastening device such as a screw, bolt, or any other securing means known in the art. (See FIG. 6, Step 608)

Securing new post 301 to original support post 101 is optional because new post 301 may not require securing for various reasons, including the consideration of the weight of the new fence in acting as its own support and the gap between the original support post 101 and new post 301. For example, if new post 301 is relatively heavy and the gap is relatively small, then new post 301 may be relatively stable when inserted over original support post 101 and not need securing to original support post 101.

Figure 5:
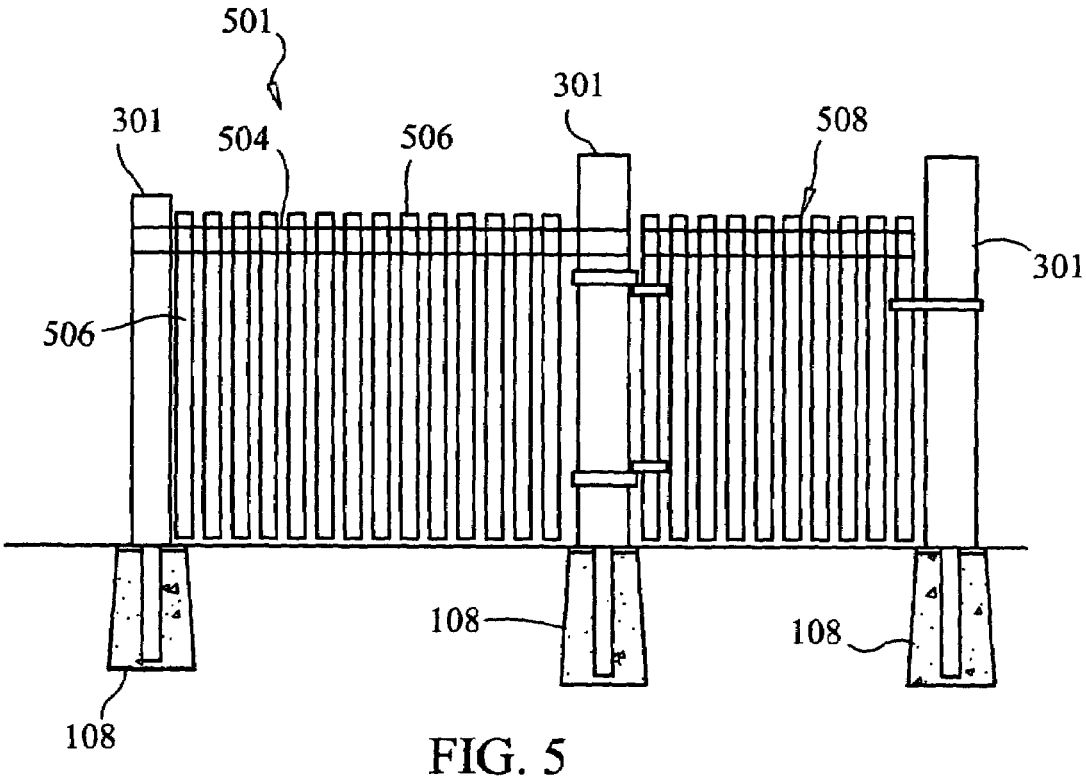
FIG. 5 is an example of the remaining structure of the new fence as attached to the new posts as a completed embodiment of the present invention.

After new post 301 has been positioned over original support post 101, new fence 501 is secured to new post 301. As shown in FIG. 5, the main body of new fence 501 may include cross beam 504, vertical pickets or planks 506, gate 508, or other components necessary or desirable to create new fence 501. While new fence 501 is shown as a picket fence, any type of fence may be used such as stockade, vinyl, or any other alternative to the original chain link fence.

The method and apparatus of the present invention provide for the conversion of a chain link fence into a more aesthetically pleasing fence such as a picket fence, a stockade fence, vinyl fence, or any other alternative to the original chain link fence. The method may be best understood with reference to FIG. 6.

The first step in the method is to remove all the parts of an existing chain link fence except the original support post and anchor, Step 602. Next, a new post is cored to fit over the original support post, Step 604. Then, the new post is positioned over the original support post, Step 606. Next, the new post is secured to the original support post, Step 608. Finally, the remainder, or a portion, of the new fence is connected to the new fence post, Step 610.

The type of new fence and materials to be used for the new fence may be any material used for fencing including but not limited to wood, metal, plastic, vinyl, or any other material known in the art for use in fencing. Furthermore, the present invention includes the conversion of a chain link fence into another, potentially larger chain link fence with new fence posts that adapt to the method of the present invention and allow for a new fence posts to be positioned over and encompass the original supporting posts.

In addition, a new modular type fence may be created where no fence had existed before. The steps would be the same as described above except for the first step of removing the existing chain link fence. After support posts and anchors are installed, the above described method is used to create the new fence.

The fence is modular in the sense that new fence posts may be easily installed to replace the existing fence posts. When new fence posts are desired, the old fence posts are removed from the support posts and the new fence posts are inserted over and secured to the support posts. This eliminates the need to dig out the old fence posts and anchor the new fence posts and makes changing the fence much easier and more economical.

Although the invention has been described with reference to one or more preferred embodiments, this description is not to be construed in a limiting sense. There is modification of the disclosed embodiments, as well as alternative embodiments of this invention, which will be apparent to persons of ordinary skill in the art, and the invention shall be viewed as limited only by reference to the following claims.

What is claimed is:

1. A method for converting a chain link fence having support posts with a defined cross sectional area into a new type of fence, the method comprising the steps of: removing all parts of the chain link fence except for the original supporting post; coring a new post to create a cavity of greater cross sectional area than the defined cross sectional area of the original support post; positioning the new post over the original support post, and connecting remaining parts of the new type of fence to create a new type of fence.

2. The method of claim 1, wherein the cross sectional area of the cavity is at least 1/100 of an inch larger than the defined cross sectional area of the original supporting post.

3. The method of claim 1, wherein the cross sectional area of the cavity is at least 1/64 of an inch larger than the defined cross sectional area of the original supporting post.

4. The method of claim 1, wherein the step of positioning the new post over the original supporting post is followed by securing the new post to the original support post.

5. The method of claim 4, wherein the new post is secured to the original supporting post with at least one bolt or screw.

6. The method of claim 4, wherein the new post is secured to the original supporting post by adhesive, foam, composite, or injection molding.

7. The method of claim 1, wherein after the new post is cored to create the cavity, the original support post is conditioned to accept the new post.

8. The method of claim 7, wherein the step of conditioning includes adding a temporary lubricant to facilitate easy positioning of the new post over the original supporting post.

9. The method of claim 7, wherein the step of conditioning includes applying an adhesive to secure the new post to the original support post.

10. The method of claim 1, wherein the new fence post is made of wood.

11. The method of claim 1, wherein the new fence post is made of metal.

12. The method of claim 1, wherein the new fence posts are made of plastic.

13. The method of claim 1, wherein the new fence post is made of vinyl.

14. The method of claim 1, wherein the new fence is a picket fence.

15. The method of claim 1, wherein the new fence is a stockade fence.

16. A method for creating a new, modular type fence, the method comprising the steps of: constructing a support post with a defined cross sectional area, anchoring the support post; coring a post to create a cavity of greater cross sectional area than the defined cross sectional area of the support post; positioning the post over the support post, and connecting remaining parts of the new modular type of fence to complete the new modular type of fence.

* * * * *